US010064511B1

(12) United States Patent
Cho

(10) Patent No.: US 10,064,511 B1
(45) Date of Patent: Sep. 4, 2018

(54) PORTABLE SHOEHORN APPARATUS AND METHOD OF USE

(71) Applicant: John Cho, Plano, TX (US)

(72) Inventor: John Cho, Plano, TX (US)

( * ) Notice: Subject to any disclaimer, the term of this patent is extended or adjusted under 35 U.S.C. 154(b) by 0 days.

(21) Appl. No.: 15/371,143

(22) Filed: Dec. 6, 2016

(51) Int. Cl.
*A47G 25/82* (2006.01)

(52) U.S. Cl.
CPC ..... *A47G 25/82* (2013.01)

(58) Field of Classification Search
CPC ..... A47G 25/80; A47G 25/82; A47G 25/84; A47G 25/86
USPC ..... D2/641, 642
See application file for complete search history.

(56) References Cited

U.S. PATENT DOCUMENTS 396,411 A * 1/1889 McKenty ..... A47G 25/82 223/119
1,163,399 A * 12/1915 Fox ..... A47G 25/82 223/118
3,407,423 A * 10/1968 Hauser ..... A47G 25/82 15/105
4,290,539 A * 9/1981 Lowery ..... A47G 25/82 223/118
6,474,518 B1 * 11/2002 Diaz-Acosta ..... A47G 25/82 223/118
9,498,077 B2 * 11/2016 Carlson ..... A47G 25/905

FOREIGN PATENT DOCUMENTS

JP 11206545 A * 8/1999

* cited by examiner

*Primary Examiner* — Ismael Izaguirre

(74) *Attorney, Agent, or Firm* — Eldredge Law Firm, LLC; Richard Eldredge

(57) ABSTRACT

A shoehorn apparatus includes an elastic body forming a rectangular shape; an opening extending through a thickness of the elastic body from a top surface to a bottom surface; and a handle cutout. The handle cutout includes a linear edge integrally attached to the body; and an elliptical edge extending form a first end of the linear edge to a second end of the linear edge.

1 Claim, 4 Drawing Sheets

PORTABLE SHOEHORN APPARATUS AND METHOD OF USE

BACKGROUND

1. Field of the Invention

The present invention relates generally to footwear systems, and more specifically, to a shoehorn system for assisting the insertion of a foot into a shoe.

2. Description of Related Art

Footwear systems are well known in the art and are effective means to protect a user's feet. For example, FIG. 1 depicts a conventional shoehorn system 101 having a, a shoe 103 and a shoehorn 105. During use, the shoehorn 105 is placed on the rear of the shoe and a foot 107 engages the shoehorn 105 by the heel and slips in the shoe 103 and the shoehorn 105 is extracted from the shoe 103.

One of the problems commonly associated with system 101 is its limited use. For example, the shoehorn 105 is not conveniently transported resulting in the use of a user's fingers which are painfully removed after the foot 103 is placed in the shoe 103.

Accordingly, although great strides have been made in the area of shoehorn systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
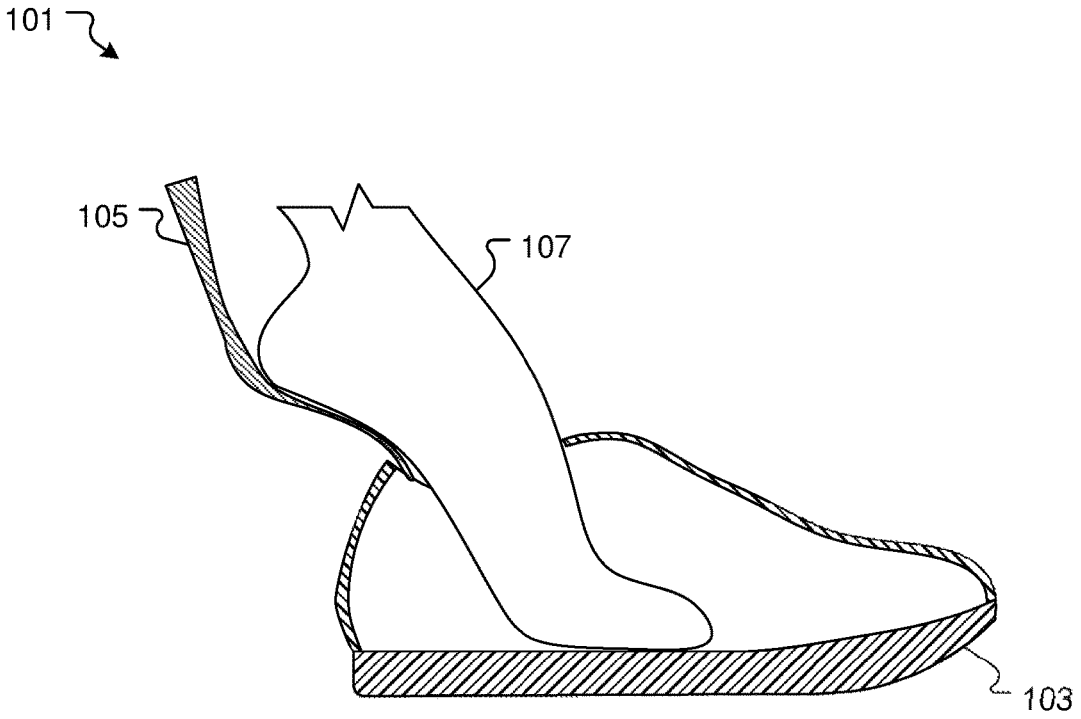
FIG. 1 (Prior Art)
FIG. 1 is a cutaway side view of a common shoehorn system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional shoehorn systems. Specifically, the apparatus of the present application provides for a portable shoehorn that can easily be removed from a shoe after use. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
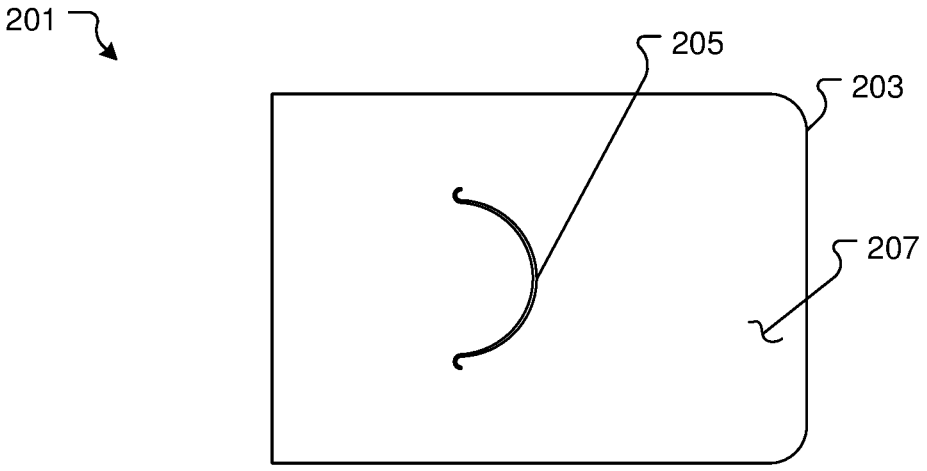
FIGS. 2 and 3 are top and perspective views of a portable shoehorn apparatus in accordance with a preferred embodiment of the present application.
Figure 3:
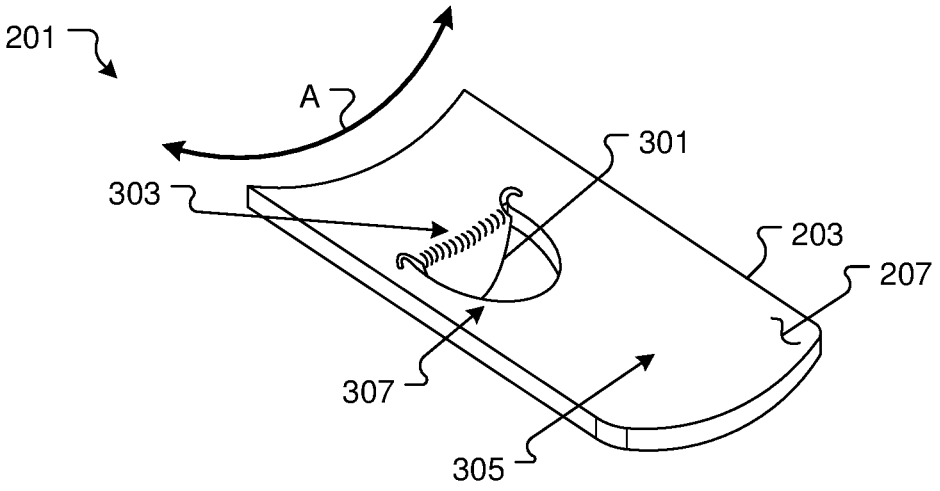

Referring now to the drawings wherein like reference characters identify corresponding or similar elements throughout the several views, FIGS. 2 and 3 depict respectively top and perspective views of a portable shoehorn apparatus in accordance with a preferred embodiment of the present application. It will be appreciated that apparatus 201 overcomes one or more of the above-listed problems commonly associated with conventional shoehorn systems.

In the contemplated embodiment, apparatus 201 includes an elastic body 203 composed of semi-rigid material and handle cutout 205 extending through the thickness thereof. In use, body 203 is bent as depicted by motion A creating a channel 305 on upper surface 207 to direct a foot into a shoe. While body 203 is bent, handle 301 extends away from the body 203 as depicted. It will be understood that handle 301 remains in a bent position along hinge line 303 and forms an opening 307. It will be appreciated that the rounded ends of the cutout 205 prevent tears in elastic body 203 as the handle 301 is bent and pulled during use.

Figure 4A:
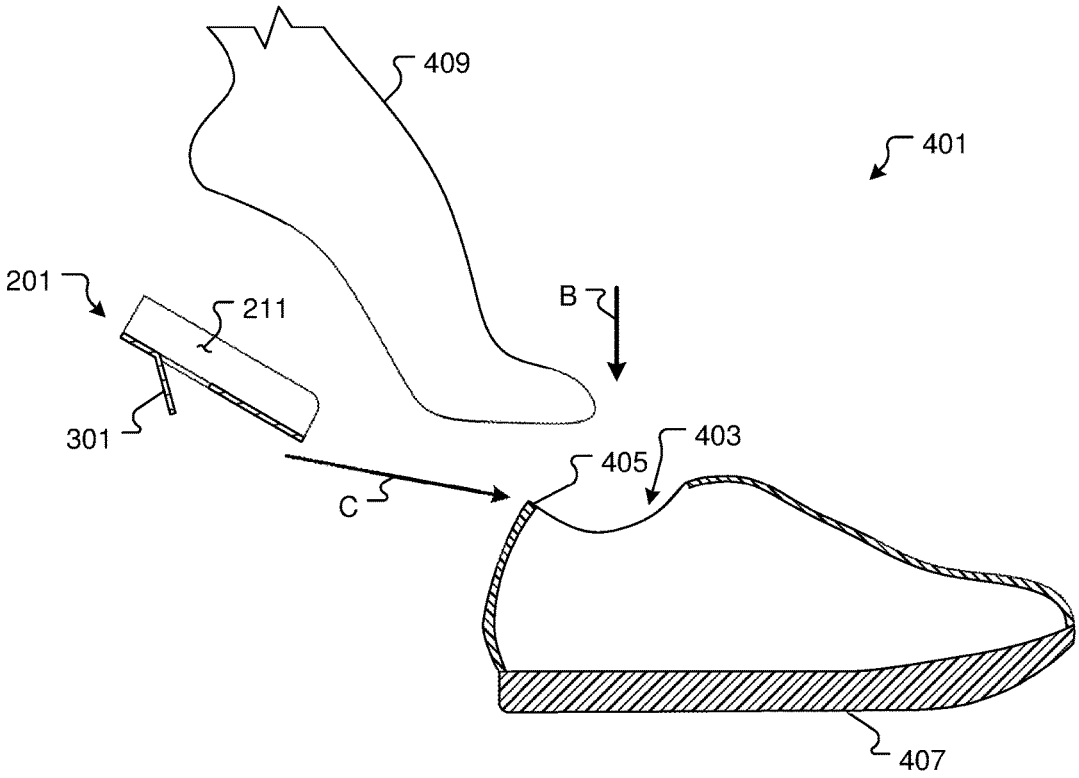
FIGS. 4A and 4B are cross-sectional side views the apparatus of FIGS. 2 and 3 in use.
Figure 4B:
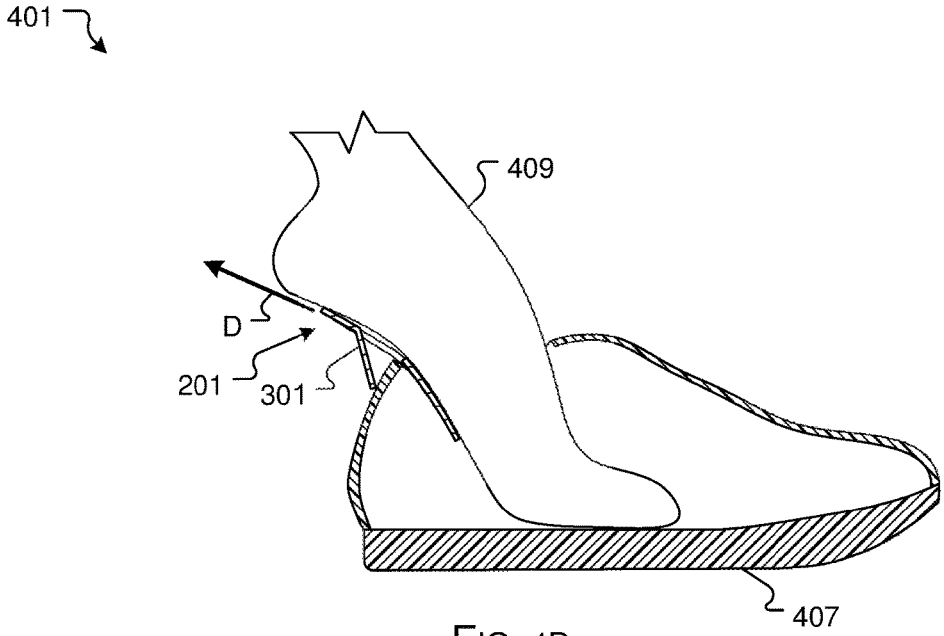

Referring now to FIGS. 4A and 4B cross-sectional views of the shoehorn apparatus 201 are shown. A shoehorn apparatus 201 is placed against rear lip 405 of opening 403 of shoe 407 as depicted by motion C. A foot 409 is placed on the upper surface 207 of body 203 as depicted by motion B and slides along channel 305 until inside shoe 407. The portable shoehorn apparatus 201 is then removed from the shoe 305 by pulling on handle 301 as depicted by motion D.

It should be appreciated that one of the unique features believed characteristic of the present application is that handle cutout 205 and the resulting handle 301 enable portable shoehorn 201 to be removed from shoe 407 after foot 409 is in shoe 407. It will also be appreciated that body 203 when not bent forms a flat planner shape and is contemplated to be of a size that would fit in a wallet or purse to facilitate transport. Another feature believed characteristic of the present application is that body 203 can be bent to create channel 305 to conform to various sizes and shapes of feet 409.

Figure 5:
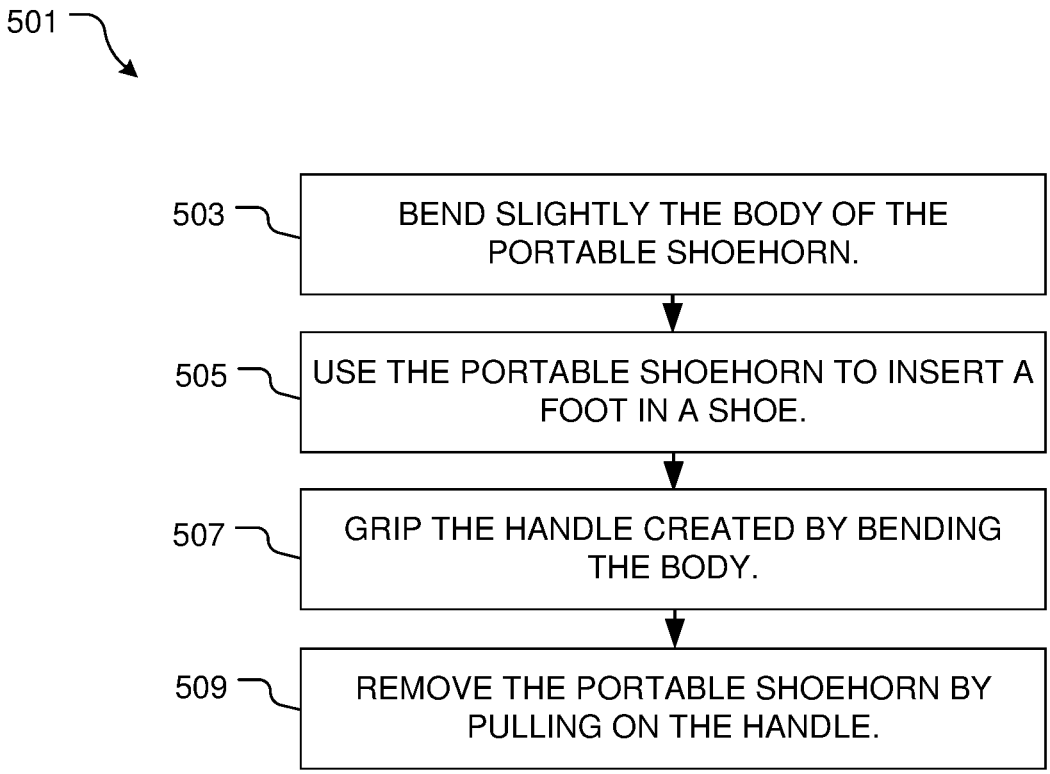
FIG. 5 is a diagram of the preferred method of use of the system of FIGS. 2 and 3.

Referring now to FIG. 5 the preferred method of use of apparatus 201 is depicted, method 401 comprising bending slightly the body of the portable shoehorn 503, using the portable shoehorn to insert a foot in a shoe 505, gripping the handle created by the bending the body 507 and removing the portable shoehorn by pulling on the handle 509.

In one contemplated embodiment, the elastic body could include a liner of slippery material that allows the foot to slip thereon for ease of use, while the opposing surface of the elastic body could include a grippy material that allows the body to engage with the shoe during use.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A shoehorn apparatus, comprising:

an elastic body forming a rectangular shape;

an opening extending through a thickness of the elastic body from a top surface to a bottom surface;

a handle cutout positioned near a center of the elastic body, the handle cutout is configured to bend outwardly from the top surface upon bending the elastic body along a longitudinal axis of the body, the handle cutout having:

a linear edge integrally attached to the body, wherein the handle cutout bends outwardly from the top surface at the linear edge; and an elliptical edge extending form a first end of the linear edge to a second end of the linear edge;

wherein the handle is composed of an elastic, pliable material;

wherein bending of the elastic body causes the elliptical edge of the handle to pivot relative to the top surface of the elastic body about the linear edge; and wherein solely by bending of the elastic body the opening is formed.

* * * * *